US011153938B2

(12) United States Patent
Hwangbo et al.

(10) Patent No.: US 11,153,938 B2
(45) **Date of Patent: *Oct. 19, 2021**

(54) COOKING VESSEL SENSOR AND INDUCTION HEATING DEVICE INCLUDING A COOKING VESSEL SENSOR

(71) Applicant: LG ELECTRONICS INC., Seoul (KR)

(72) Inventors: Kyungsoo Hwangbo, Seoul (KR); Junbo Byun, Seoul (KR); Hyeonwoo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 482 days.

This patent is subject to a terminal disclaimer.

(21) Appl. No.: 16/018,717

(22) Filed: Jun. 26, 2018

(65) Prior Publication Data

US 2018/0376541 A1 Dec. 27, 2018

(30) Foreign Application Priority Data

Jun. 26, 2017 (KR) ..... 10-2017-0080801

(51) Int. Cl.
*H05B 6/06* (2006.01)
*H05B 1/02* (2006.01)

(52) U.S. Cl.
CPC ..... *H05B 6/062* (2013.01); *H05B 1/0266* (2013.01); *H05B 2213/05* (2013.01); *H05B 2213/06* (2013.01); *H05B 2213/07* (2013.01)

(58) Field of Classification Search
CPC .. H05B 2213/05; H05B 6/062; H05B 1/0266; H05B 2213/06; H05B 2213/07; H05B 6/1245; H05B 6/365
(Continued)

(56) References Cited

U.S. PATENT DOCUMENTS 5,296,684 A 3/1994 Essig et al.
5,877,625 A * 3/1999 Togo ..... G01R 33/02 324/174

(Continued)

FOREIGN PATENT DOCUMENTS

DE 195 02 935 8/1996
EP 0 442 275 8/1991

(Continued)

OTHER PUBLICATIONS

Korean Office Action dated Apr. 3, 2019 issued in Application No. 10-2017-0080800.

(Continued)

*Primary Examiner* — Dana Ross
*Assistant Examiner* — Joe E Mills, Jr.
(74) *Attorney, Agent, or Firm* — Ked & Associates LLP

(57) ABSTRACT

A cooking vessel sensor and an induction heating device including a cooking vessel sensor is provided. The cooking vessel sensor may include a cylindrical hollow body having a first receiving space defined therein; a hollow cylindrical magnetic core received in the first space and having a second receiving space defined therein; and a sensing coil wound on an outer face of the side wall by a predetermined number of winding counts. The cylindrical hollow body may have a side wall having a coil outlet defined therein, and the sensing coil may pass through the coil outlet out of the body. The cooking vessel sensor may further include a controller that applies a current to the sensing coil and determines, based on a sensing result of the cooking vessel sensor, whether the cooking vessel is inductive or has an inductive heating property.

20 Claims, 8 Drawing Sheets

(58) Field of Classification Search
USPC ..... 219/446.1, 447.1, 448.1, 620–627
See application file for complete search history.

(56) References Cited

U.S. PATENT DOCUMENTS

| | | | | |
|---|---|---|---|---|
| 2004/0135572 | A1* | 7/2004 | Nakazaki ..... | H03K 17/9505 324/200 |
| 2005/0083041 | A1* | 4/2005 | Schwartzbart ..... | G01B 7/003 324/207.17 |
| 2016/0150600 | A1 | 5/2016 | Lomp et al. | |

FOREIGN PATENT DOCUMENTS

| | | |
|---|---|---|
| EP | 2 312 908 | 4/2011 |
| EP | 2 981 154 | 2/2016 |
| EP | 3 026 981 | 6/2016 |
| JP | H06-078833 | 11/1994 |
| JP | 2001-068260 | 3/2001 |
| JP | 6038345 | 12/2016 |
| KR | 10-1999-002751 | 1/1999 |
| KR | 10-2014-0131118 | 11/2014 |
| WO | WO 2014/090868 | 6/2014 |
| WO | WO 2015/032422 | 3/2015 |

OTHER PUBLICATIONS

Korean Office Action dated Apr. 3, 2019 issued in Application No. 10-2017-0080801.
U.S. Appl. No. 16/018,835, filed Jun. 26, 2018, Tu Ba Hoang.
European Search Report dated Dec. 3, 2018.
European Search Report dated Nov. 15, 2018.
Korean Office Action dated Aug. 14, 2020.

* cited by examiner

COOKING VESSEL SENSOR AND INDUCTION HEATING DEVICE INCLUDING A COOKING VESSEL SENSOR

CROSS-REFERENCE TO RELATED APPLICATION(S)

This application claims priority to and the benefit of Korean Patent Application No. 10-2017-0080801, filed in Korea on Jun. 26, 2017, the disclosure of which is incorporated herein by reference in its entirety.

BACKGROUND

1. Field

A cooking vessel sensor and an induction heating device including a cooking vessel sensor is disclosed herein.

2. Background

In homes and restaurants, cooking utensils applying various heating methods to heat food, food containers, or other food products (hereinafter, "food") are used. Conventionally, gas ranges that use gas as fuel have been widely used. However, in recent years, there has been an increase in the use of devices that may heat a cooking vessel such as a pot or container, with electricity instead of gas.

A cooking vessel, such as a pot or container, may be heated via electricity by resistive heating or inductive heating. In the electrical resistive heating method, heat is generated when current flows through a metal resistance wire or a non-metallic heating element, such as silicon carbide, and is transmitted to a cooking vessel via radiation or conduction, thereby heating the cooking vessel. In the inductive heating method, a high-frequency power of a predetermined magnitude is applied to a working coil such that a magnetic field is generated around the working coil and an eddy current is generated in a cooking vessel made of a metal, such that the cooking vessel itself is heated.

The principle of induction heating is as follows. First, as power is applied to an induction heating device, a high-frequency voltage of a predetermined magnitude is applied to a working coil. Accordingly, a magnetic field is generated around the working coil, which is disposed in an induction heating device. When the flux of the generated inductive magnetic field passes through a bottom of a cooking vessel containing metal that is loaded on the induction heating device, an eddy current is generated inside the bottom of the cooking vessel. The resulting eddy current flows in the bottom of the cooking vessel, thereby heating the cooking vessel.

When the induction heating device is used, a plate of the induction heating device may not be heated; rather, only the cooking vessel itself may be heated. Thus, when the cooking vessel is lifted up from the plate, the inductive magnetic field around the working coil may be extinguished, and the cooking vessel may immediately cease to be heated. Further, as the working coil in the induction heating device may not be heated, a temperature of the plate may be kept at a relatively low temperature even during cooking, making the device safe to use.

As the induction heating device may heat only the cooking vessel itself by induction heating, the device may be more energy-efficient than a gas-range or resistance heating device. Another advantage of such an induction heating device is that it may heat the cooking vessel faster than other heating devices. The higher the output of the induction heating device, the faster the cooking vessel may be heated.

However, the types of cooking vessels that may be used with an induction heating device are limited to those in which an eddy current can be generated when high-frequency power is supplied to the working coil of the induction heating device; for example, a metal or ferromagnetic object. It is therefore advantageous to accurately determine whether the cooking vessel placed on the induction heating device may be heated via induction.

Conventionally, a predetermined amount of power is supplied to the working coil inside the induction heating device for a predetermined time to determine whether the previously described eddy current occurs in the cooking vessel. This process determines the type of cooking vessel and whether it is suitable for induction heating. However, according to this method, excessive power (for example, 200 W or more) is consumed in order to determine suitability of the cooking vessel. Therefore, a new induction heating device is needed that accurately and quickly identifies the type of cooking vessel while consuming less power.

BRIEF DESCRIPTION OF THE DRAWINGS

Embodiments will be described in detail with reference to the following drawings in which like reference numerals refer to like elements, and wherein.

DETAILED DESCRIPTION

Figure 1:
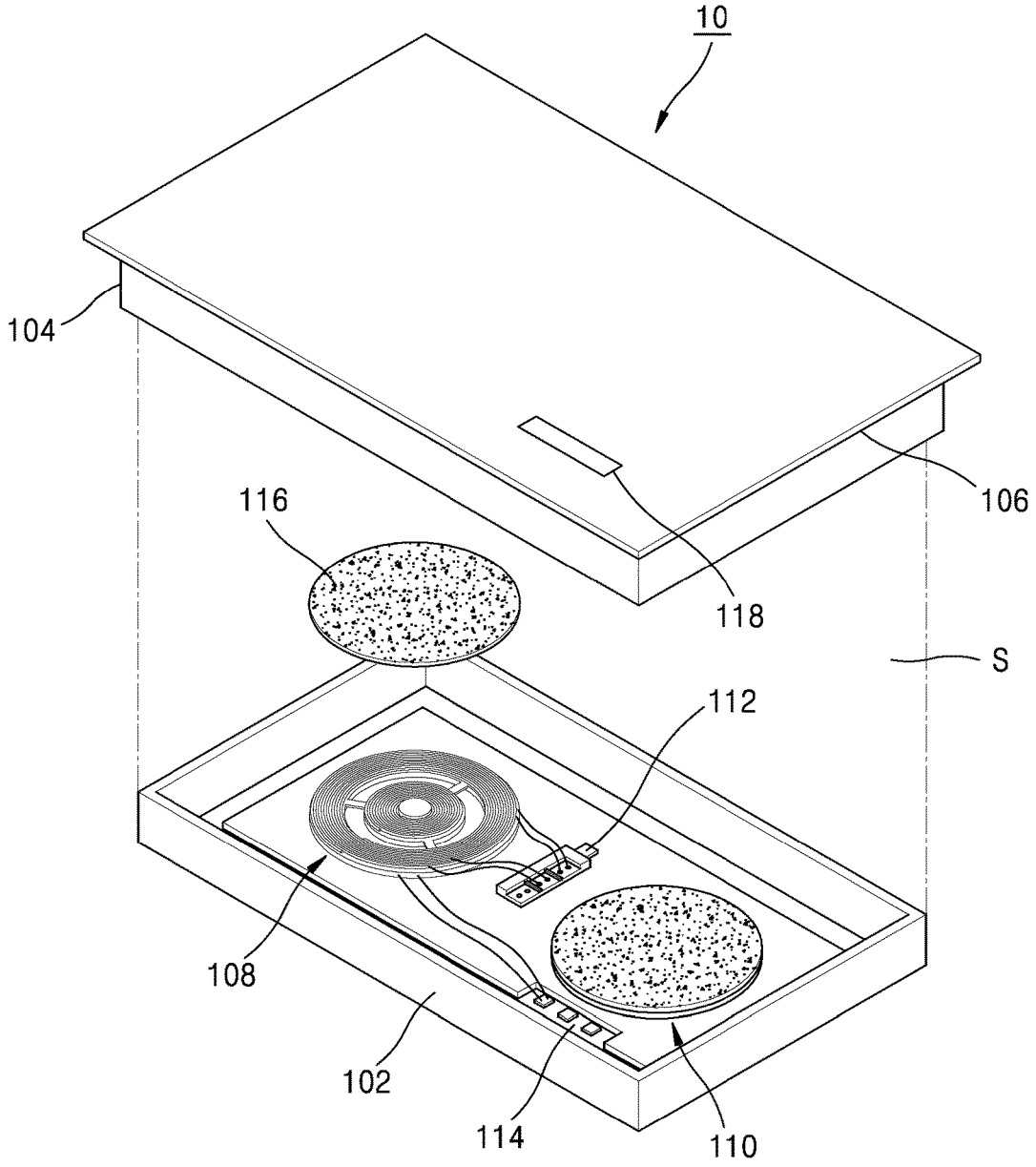
FIG. 1 is a schematic representation of an induction heating device according to an embodiment.

FIG. 1 is a schematic representation of an induction heating device according to an embodiment. Referring to FIG. 1, an induction heating device 10 according to an embodiment may include a casing 102 constituting a main body, and a cover plate 104 that may be coupled to the casing 102 to seal the casing 102. The cover plate 104 may be coupled with a top face of the casing 102 to seal a space S defined inside the casing 102 from the outside. The cover plate 104 may include a plate 106 on which a cooking vessel such as a cooking vessel (for example, a cooking pot or pan or container) may be placed. In an exemplary embodiment, the plate 106 may be made of a tempered glass material such as ceramic glass.

Referring again to FIG. 1, working coil assemblies 108 and 110 that may heat the cooking vessel may be provided in the space S formed inside the casing 102. Inside the casing 102, an interface 114 may be further provided that allows a user to apply power, to control an output of the working coil assembles 108 and 110, and to view displayed information related to the induction heating device 10. The interface 114 may be a touch panel capable of both information input via touch and information output via display. However, the embodiments disclosed herein are not limited thereto, and an interface 114 having a different configuration may be used.

A manipulation region 118 may be provided with the plate 106 at a position that corresponds to the interface 114. The manipulation region 118 may be pre-printed with characters and images, for example. The user may perform a desired manipulation by touching a specific point in the manipulation region 118 corresponding to the pre-printed character or image. The information output from the interface 114 may be displayed through the plate 106. A power supply 112 that supplies power to the working coil assemblies 108 and 110 and the interface 114 may be provided in the space S formed inside the casing 102.

In FIG. 1, the two working coil assemblies 108 and 110 are shown inside the casing 102. However, in other embodiments disclosed herein, one working coil assembly may be provided within the casing 102, or three or more working coil assemblies may be provided.

Each of the working coil assemblies 108 and 110 may include a working coil that generates an inductive magnetic field using a high frequency alternating current supplied thereto by the power supply 112, and a thermal insulating sheet 116 that protects the coil from heat generated by a cooking vessel. Depending on the embodiment, the thermal insulating sheet 116 may be omitted. Although not shown in FIG. 1, a controller 702 may be provided in the space S formed inside the casing 102. The controller 702 may receive a user command via the interface 114 and may control the power supply 112 to activate or deactivate the power supplied to the working coil in the working coil assemblies 108 and 110 based on the user command.

Figure 2:
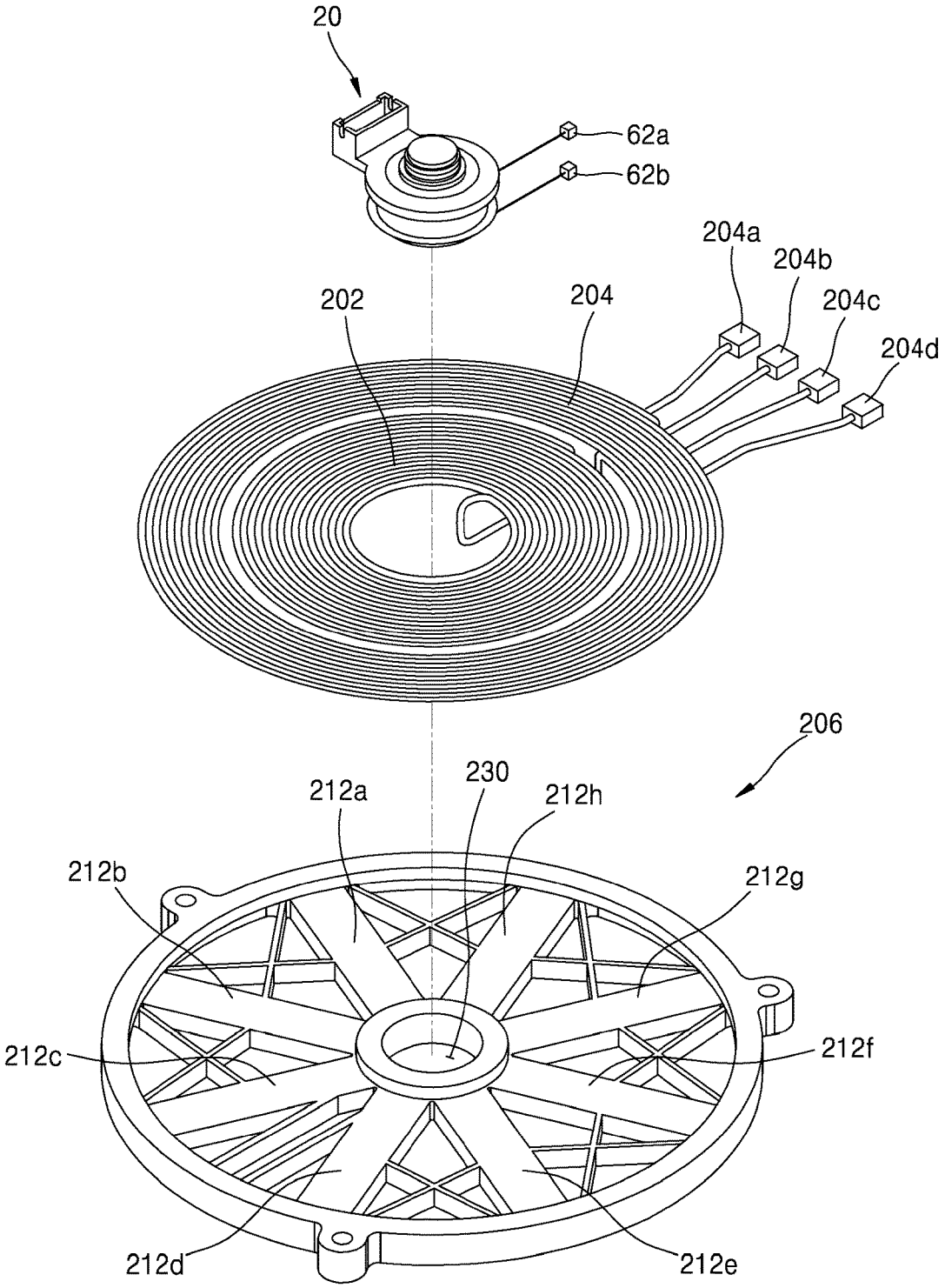
FIG. 2 is a perspective view showing a structure of a working coil assembly included in an induction heating device according to an embodiment.
Figure 3:
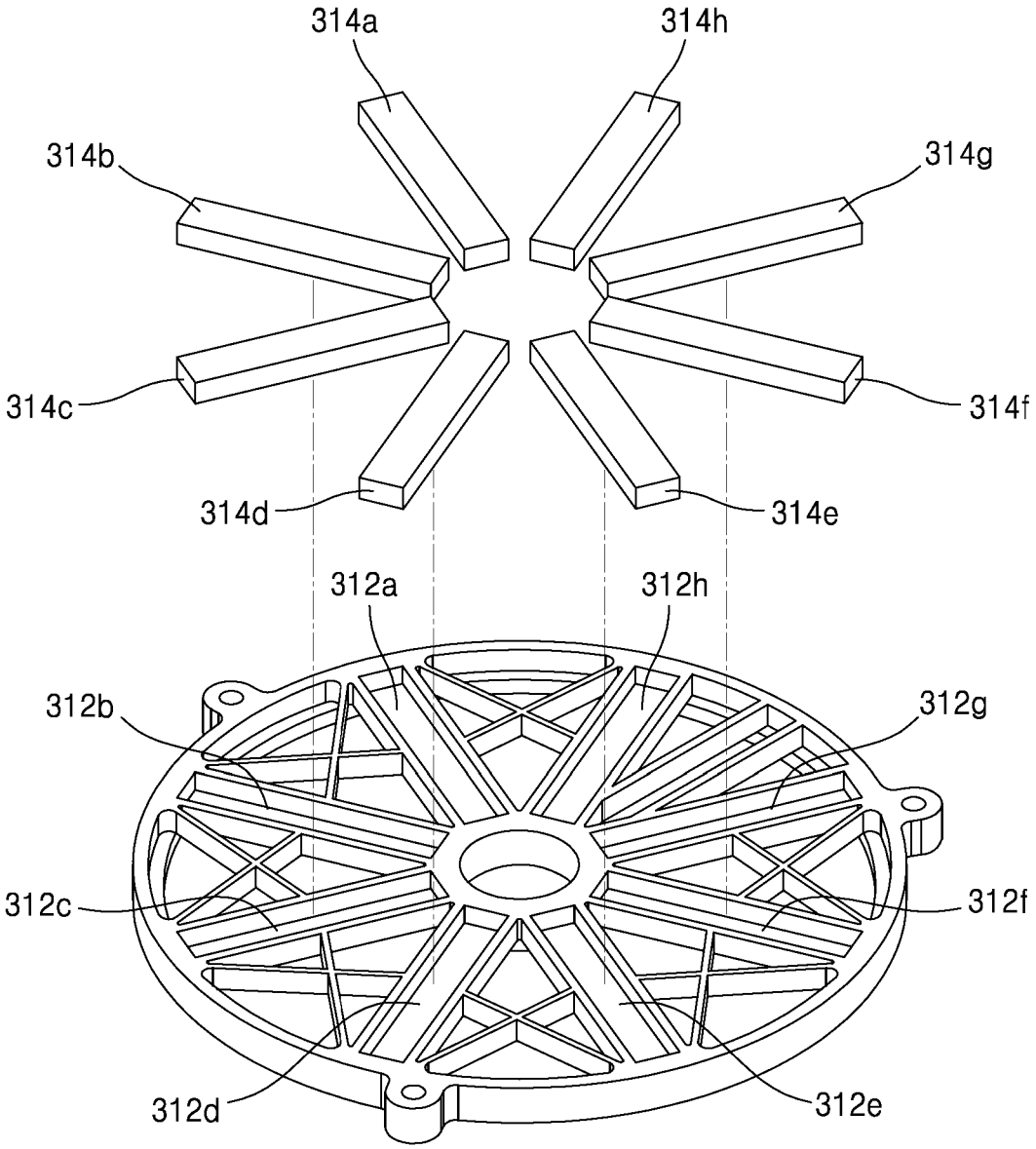
FIG. 3 is a perspective view showing a coil base included in the working coil assembly according to an embodiment.

Hereinafter, with reference to FIGS. 2 and 3, a structure of the working coil assembly included in the induction heating device according to an embodiment will be described. FIG. 2 is a perspective view showing a structure of a working coil assembly included in an induction heating device according to an embodiment. Further, FIG. 3 is a perspective view showing a coil base included in the working coil assembly according to an embodiment.

Referring to the drawings, the working coil assembly according to an embodiment may include a first working coil 202, a second working coil 204, and a coil base 206. The first working coil 202 may be mounted on the coil base 206 and may be wound circularly by a first rotation count in a radial direction. Further, a second working coil 204 may be mounted on the coil base 206, and may be wound concentrically with the first working coil 202 in a circular shape by a second rotation count in the radial direction. The first working coil 202 may be located inside the second working coil 204.

A rotation count of the first working coil 202 and a rotation count of the second working coil 204 may vary. The sum of the rotation count of the first working coil 202 and the rotation count of the second working coil 204 may be limited by a size of the coil base 206 and specifications of the induction heating device and a wireless power transmission device. Both ends of the first working coil 202 and both ends of the second working coil 204 may extend outside the first working coil 202 and the second working coil 204, respectively. Connectors 204*a* and 204*b* may be respectively connected to both ends of the first working coil 202, while connectors 204*c* and 204*d* may be respectively connected to both ends of the second working coil 204. The first working coil 202 and the second working coil 204 may be electrically connected to the controller 702 or the power supply 112 via the connectors 204*a*, 204*b*, 204*c* and 204*d*. According to an embodiment, each of the connectors 204*a*, 204*b*, 204*c*, and 204*d* may be implemented as a conductive connection terminal.

The coil base 206 may accommodate the first working coil 202 and the second working coil 204, and may be made of a nonconductive material. In the region where the first working coil 202 and the second working coil 204 are mounted, receptacles 212*a* to 212*h* may be formed in the lower portion of the coil base 206 to receive magnetic sheets; for example, ferrite sheets as described hereinafter.

As shown in FIG. 3, receptacles 312*a* to 312*h* may be formed at the lower portions of the coil base 206 to accommodate ferrite sheets 314*a* to 314*h*. The ferrite sheets 314*a* to 314*h* may extend in a radial direction of the first working coil 202 and the second working coil 204. A number, shape, position, and cross-sectional area of ferrite sheets 314*a* to 314*h* may vary depending on the embodiment.

As shown in FIG. 2 and FIG. 3, the first working coil 202 and the second working coil 204 may be mounted on the coil base 206. A magnetic sheet, such as ferrite sheets 314*a* to 314*h*, may be mounted under the first working coil 202 and the second working coil 204. This magnetic sheet may prevent a flux generated by the first working coil 202 and the second working coil 204 from being directed below the coil base 206, which may increase a flux density produced by the first working coil 202 and the second working coil 204.

As shown in FIG. 2, a cooking vessel sensor 20 according to an embodiment may be provided in a central region of the first working coil 202. In FIG. 2, the cooking vessel sensor 20 may be provided concentrically with the first working coil 202, but depending on the embodiment, a position of the cooking vessel sensor 20 may vary. A sensing coil 44 may be wound by a predetermined rotation count on an outer face of a body of the cooking vessel sensor 20. Both ends of the sensing coil 44 may be connected to connectors 62*a* and 62*b*, respectively. The sensing coil may be electrically connected to the controller 702 or the power supply 112 via the connectors 62*a* and 62*b*. The controller 702 may supply current to the sensing coil 44 through the connectors 62*a* and 62*b* of the cooking vessel sensor 20 to determine a type of the cooking vessel; that is, the controller may determine whether or not the cooking vessel has inductive heating properties, or whether or not an eddy current can occur in the cooking vessel.

Figure 4:
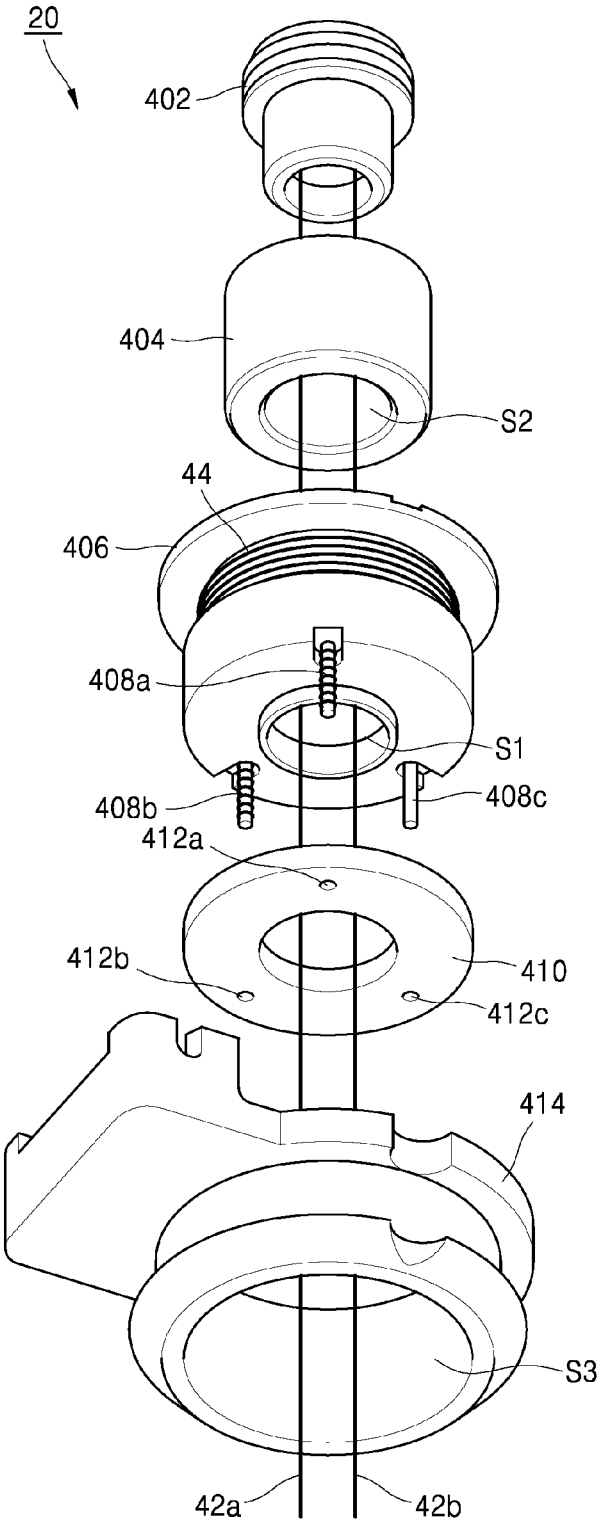
FIG. 4 is a perspective view of each component of a cooking vessel sensor according to an embodiment.
Figure 5:
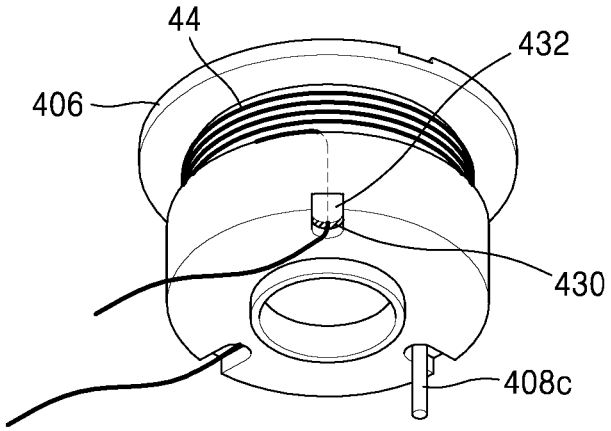
FIG. 5 is a perspective view showing a configuration of a body included in a cooking vessel sensor according to an embodiment.
Figure 6:
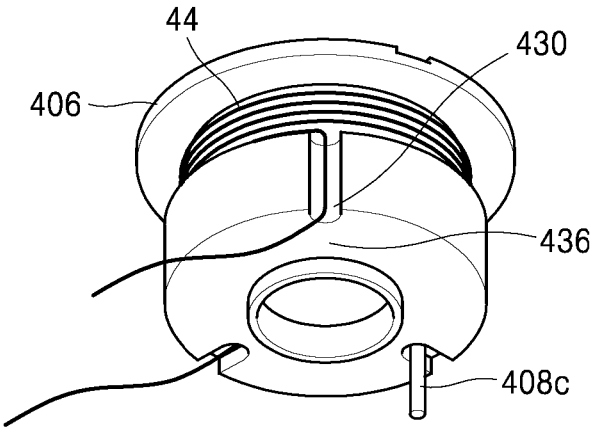
FIG. 6 is a perspective view showing a structure of a body included in a cooking vessel sensor according to another embodiment.
Figure 7:
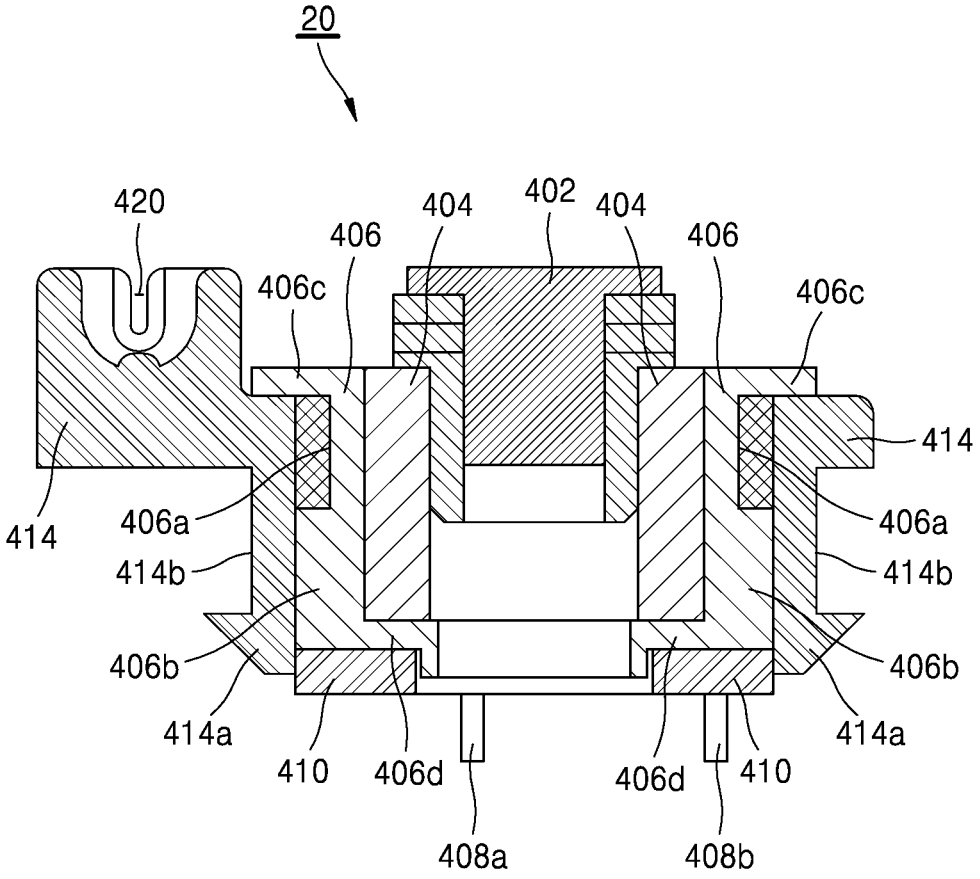
FIG. 7 is a vertical cross-sectional view showing an assembled state of components constituting the cooking vessel sensor according to an embodiment.
Figure 8:
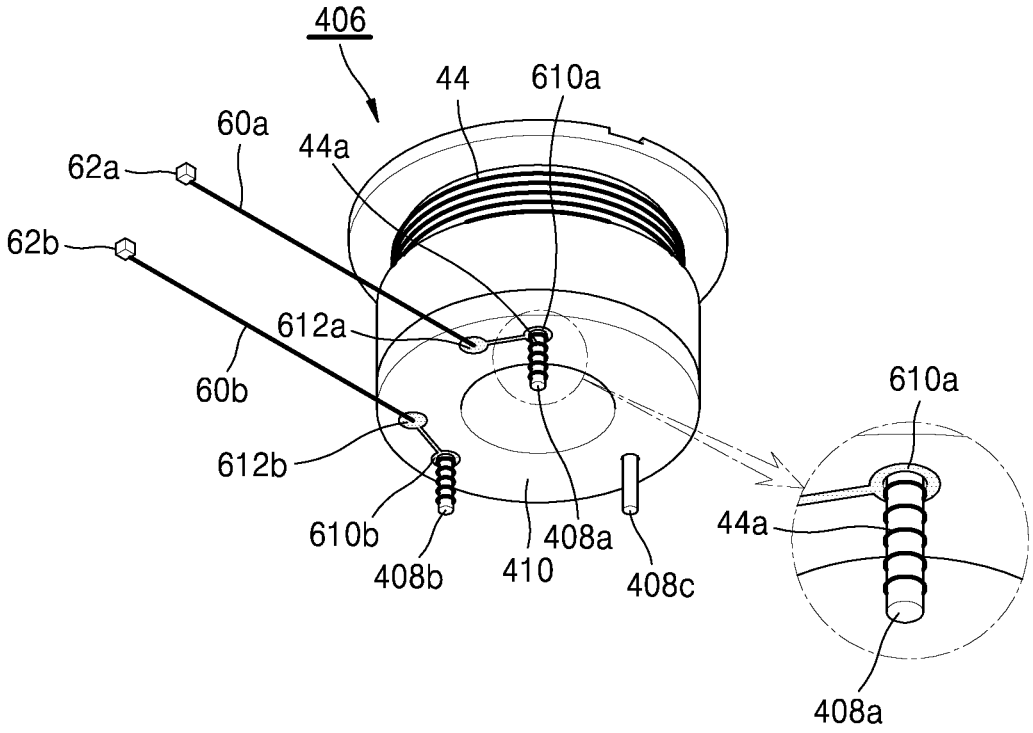
FIG. 8 is a perspective view showing combined body and substrate according to an embodiment.

Hereinafter, a configuration and function of the cooking vessel sensor 20 according to an embodiment will now be described with reference to FIGS. 4 to 8. FIG. 4 is a perspective view of each component of a cooking vessel sensor according to an embodiment. FIG. 5 is a perspective view showing a configuration of a body included in a cooking vessel sensor according to an embodiment. FIG. 6 is a perspective view showing a structure of a body included in a cooking vessel sensor according to another embodiment. FIG. 7 is a vertical cross-sectional view showing an assembled state of components constituting the cooking vessel sensor according to an embodiment. FIG. 8 is a perspective view showing combined body and substrate according to an embodiment.

Referring to the drawings, the cooking vessel sensor 20 according to an embodiment may include a temperature sensor 402, a magnetic core 404, a body 406, a substrate 410, and a guide 414. The body 406 may have a hollow cylindrical shape. A first receiving space S1 that accommodates the magnetic core 404 may be defined inside the body 406. The magnetic core 404 may have a hollow cylindrical shape and may be made of a magnetic material, such as ferrite. The magnetic core 404 may increase the density of the flux induced in the sensing coil 44 when current flows through the sensing coil 44.

A second receiving space S2 may be formed inside the magnetic core 404. A temperature sensor 402 may be received within the second receiving space S2 of the magnetic core 404. The temperature sensor 402 may be configured to measure a temperature of a cooking vessel. The temperature sensor may have wires 42*a* and 42*b* that may electrically connect to the controller 702 or the power supply 112. The wires 42*a* and 42*b* of the temperature sensor 402 may extend outwardly through an open bottom of the magnetic core 404, an open bottom of the body 406, and an opening in the substrate 410.

Referring again to the drawings, a first flange 406*c* may extend horizontally outward from a top of the body 406. The first flange 406*c* may engage with a top end of the hollow guide 414 and may support the body 406 when the body 406 is inserted into the hollow guide 414. A second flange 406*d* may extend horizontally outward from a lower end of the body 406. The second flange 406*d* may engage with the magnetic core 404 to support the magnetic core 404 when the magnetic core 404 is inserted into the first receiving space S1 of the body 406.

On an outer face of the body 406, the sensing coil 44 may be wound by a predetermined rotation count. The body 406 may have an upper hollow portion or first outer face 406*a* having a relatively small outer diameter, and a lower hollow portion or second outer face 406*b* having an outer diameter larger than that of the upper hollow portion 406*a*. In an exemplary embodiment, the sensing coil 44 may be wound on the outer face of the upper hollow portion 406*a*.

The hollow guide 414 may have a third receiving space S3 defined therein. When the body 406 is inserted into the third receiving space S3 formed inside the hollow guide 414, an outer face of the lower hollow portion 406*b* may be in contact with the inner side face of the hollow guide 414. As the upper hollow portion or first outer face 406*a* has a smaller outer diameter than that of the lower hollow portion or second outer face 406*b*, the sensing coil 44 may be provided between the inner side face of the hollow guide 414 and the outer side face of the upper hollow portion 406*a*. Further, the outer diameters of the upper hollow portion 406*a* and the lower hollow portion 406*b* may be configured such that the sensing coil 44 wound on the upper hollow portion 406*a* does not contact the inner face of the hollow guide 414 when the body 406 is inserted into or removed out of the hollow guide 414.

The sensing coil 44 wound on the outer face of the upper hollow portion 406*a* may extend out of the body 406 to electrically connect with the controller 702 or the power supply 112. A coil outlet or coil outlet channel 430 that draws the sensing coil 44 to the outside of the body 406 may be defined in the body 406.

For example, as shown in FIG. 5, a vertical coil outlet 430 having a hole shape from where the sensing coil 44, wound on the upper hollow portion 406*a* to the outside of the body 406, extends may be vertically defined in the lower hollow portion 406*b* of the body 406. The sensing coil 44 may thus be directly electrically coupled with the controller 702 or the power supply 112 through the coil outlet 430. In this case, a substrate 410 may not be provided. When the body 406 is inserted into the hollow guide 414, the sensing coil 44 may be easily drawn out of the body 406 without contacting the inner side face of the hollow guide 414. Alternatively, the sensing coil 44 may be wound on a lead pin (not shown) passing through a lead pin channel 432 defined vertically in the lower hollow portion or second outer face 406*b* of the body 406. The lead pin may extend in a predetermined direction through a substrate 410, and may be similar to lead pin 408*c*.

As shown in FIG. 6, a coil outlet 430 having a groove form may be defined vertically in the lower hollow portion 406*b* of the body 406. The sensing coil 44 wound around the upper hollow portion 406*a* may extend out of the body via coil outlet 430. The sensing coil 44 wound on the upper hollow portion 406*a* may pass through the coil outlet 430, may be drawn out of the body 406, and then may be directly connected to the controller 702 or the power supply 112. In this case, a substrate 410 may not be provided. When the body 406 is inserted into the hollow guide 414, the sensing coil 44 may be easily drawn out of the body 406 without contacting the inner side face of the hollow guide 414. Alternatively, the sensing coil 44 may be wound on a lead pin passing through a lead pin channel 432 defined vertically in the lower hollow portion 406*b* of the body 406. The lead pin may extend in a predetermined direction through a substrate 410. The sensing coil 44 may be electrically connected to the controller 702 or the power supply 112. In an exemplary embodiment, current may be applied to the sensing coil 44 to determine the type of the cooking vessel under control of the controller 702.

Referring again to the drawings, the sensing coil 44 may wound on the upper hollow portion 406*a* of the body 406, and then the sensing coil 44 may be wound on lead pins 408*a*, 408*b* and/or 408*c*. The lead pins 408*a*, 408*b*, and 408*c* may respectively pass through the coil outlet 430 or the lead pin channel 432 defined in the lower hollow portion 406*b* and may be drawn out of the body 406. In FIG. 4, after the sensing coil 44 is wound on the upper hollow portion 406*a*, one or a first end of the coil 44 may be wound on a first lead pin 408*a* and the other or a second end of the sensing coil 44 may be wound on a second lead pin 408*b*. In other words, in the lower hollow portion 406*b* of the body 406, multiple coil outlets, like coil outlet 430, may be defined, through which at least two lead pins (that is, 408*a*, around which one end of the sensing coil 44 may be would, and 408*b*, around which the other end of the sensing coil 44 may be wound) respectively may pass. In the FIG. 4, a third lead pin 408*c* may additionally be provided for rigid coupling between the body 406 and a substrate 410.

The substrate 410 may be provided on a lower end of the body. The lead pins 408*a*, 408*b*, and 408*c* may pass through the substrate 410. The substrate may have lead pin holes 412*a*, 412*b* and 412*c* defined therein to correspond to the lead-pins 408*a*, 408*b*, and 408*c*. Thus, the lead pins 408*a*, 408*b*, and 408*c* may pass through the holes 412*a*, 412*b*, and 412*c* respectively. When the lead pins 408*a*, 408*b*, and 408*c* pass through the lead pin holes 412*a*, 412*b*, and 412*c* defined in the substrate 410 respectively, the body 406 and the substrate 410 may be combined. The substrate 410 may be coupled to the lower end of the body 406 and may extend the sensing coil 44, which is wound on the lead-pins 408*a* and 408*b*, along a predetermined direction.

The hollow body 406 receiving the magnetic core 404 and temperature sensor 402 therein may be placed in the third receiving space S3 formed within the hollow guide 414. The hollow guide 414 may position the body 406, the magnetic core 404, and the temperature sensor 402 into a central region 230 of the coil base 206 as shown in FIG. 2. The hollow guide 414 may include a guiding portion or guide 414*a* and an engaged portion 414*b*. The guiding portion 414*a* may have an inclined face to guide the hollow guide 414 to be inserted into the central region 230 so that it may couple with the coil base 206. The guiding portion 414*a* may have a stopper to prevent the hollow guide 414 from disengaging from the central region 230 after the hollow guide 414 is inserted into the central region 230. The engaged portion 414*b* may have an outer diameter corresponding to a diameter of the central region 230 of the coil base 206. The engaged portion 414*b* may maintain contact with the central region 230 when the hollow guide 414 is inserted into the central region 230. With such a construction, the hollow guide 414 may be inserted, coupled, and secured into the central region 230 of the coil base 206. The hollow guide 414 may have an auxiliary side portion in which a receiving space 420 may be formed. Within the receiving space 420 of the auxiliary side portion, another unit or module, like the controller 702, may be accommodated.

As illustrated in FIGS. 4 and 7, the cooking vessel sensor may determine a type of the cooking vessel by measuring a current flowing through the sensing coil 44, and also by measuring a temperature of the cooking vessel using the temperature sensor 402. As the temperature sensor 402 may be received within the body 406, an overall size and volume of the induction heating device may be reduced as compared with a structure in which a temperature sensor and a cooking vessel sensor are provided separately. In addition, a placement of the sensors and utilization of the space inside the induction heating device becomes more flexible.

FIG. 8 is a perspective view showing a combined state of the body and substrate according to an embodiment. Referring to FIG. 8, the lead pins 408*a*, 408*b*, and 408*c* may pass through the lead pin holes 412*a*, 412*b*, and 412*c*, respectively, so that the body 406 and the substrate 410 may be coupled firmly to each other. As described above, one end of the sensing coil 44 wound on the outer face of the body 406 is wound on a first lead-pin 408*a*, while the other end of the sensing coil 44 is wound on a second lead-pin 408*b*.

In an exemplary embodiment, first pads or pinhole pads 610*a* and 610*b* may be formed around the first lead pin hole 412*a* and second lead pin hole 412*b* defined in the substrate 410, respectively. The first pads or pinhole pads 610*a* and 610*b* may be made of a conductor such as a metal. The first pads or pinhole pads 610*a* and 610*b* may be electrically and respectively connected to the sensing coil 44 wound on the first lead pin 408*a* and the second lead pin 408*b* via bonding such as soldering. The first pads or pinhole pads 610*a* and 610*b* may be electrically connected to second pads or wire pads 612*a* and 612*b* formed on the substrate 410, respectively. The second pads or wire 612*a* and 612*b* are made of a conductor, such as a metal, in a similar way to the first pads or pinhole pads 610*a* and 610*b*. Positions of the second pads or wire pads 612*a* and 612*b* on the substrate 410 may vary according to the embodiment. The second pads or wire pads 612*a* and 612*b* may be respectively connected to wires 60*a* and 60*b* made of a conductor such as a metal. Further, one end of each of the wires 60*a* and 60*b* may be connected to each of connectors 62*a* and 62*b* that connect to the controller 702 or the power supply 112.

According to the embodiment shown in FIG. 8, the sensing coil 44 wound on the outer face of the body 406 may pass through the first pads or pinhole pads 610*a* and 610*b*, the second pads or wire pads 612*a* and 612*b*, the wires 60*a* and 60*b*, and the connectors 62*a* and 62*b*, so that it may be electrically connected to a controller 702 or a power supply 112. As a result, the sensing coil 44 wound on the outer face of the body 406 may be extended in a predetermined direction via the substrate 410.

As illustrated in FIGS. 4 and 7, the body 406 may be inserted into the third receiving space S3 of the hollow guide 414 with the sensing coil 44 wound around the body 406. The lead pins 408*a* and 408*b* may guide both ends of the sensing coil 44 out of the body 406 and the hollow guide 414 when the body 406 is inserted into the hollow guide 414. After the sensing coil 44 is wound on the lead pins 408*a* and 408*b* and the sensing coil 44 is drawn out of the body 406 and the hollow guide 414, both ends of the sensing coil 44 may be directly connected to the controller 702 or the power supply 112. In this case, when the cooking vessel sensor 20 is assembled or repaired, or if the device vibrates, a force may be applied to the sensing coil 44. When the force is applied to the sensing coil 44 when both ends of the sensing coil 44 are directly connected to the controller 702 or the power supply 112, the sensing coil 44 may be disengaged from the lead pins 408*a* and 408*b*, or the sensing coil 44 may be disconnected.

However, as shown in FIG. 8, the sensing coil 44 connected to the lead pins 408*a* and 408*b* may be electrically connected to the first pads or pinhole pads 610*a* and 610*b* and the second pads or wire pads 612*a* and 612*b*. The wires 60*a* and 60*b* connected to the second pads or wire pads 612*a* and 612*b* may be connected to the controller 702 or the power supply 112. In this case, even when external force is applied to the sensing coil 44, the sensing coil 44 may stay engaged with the lead pins 408*a* and 408*b*, or the sensing coil 44 may be prevented from being disconnected.

When the sensing coil 44 wound on the lead pins 408*a* and 408*b* is directly connected to the controller 702 or the power supply 112, the connection between the sensing coil 44 and the controller 702 or power supply 112 may be limited. Accordingly, the arrangement of the controller 702 and the power supply 112 may also be limited. However, when the sensing coil 44 connected to the lead pins 408*a* and 408*b* is electrically connected to the first pads or pinhole pads 610*a* and 610*b* and second pads or wire pads 612*a* and 612*b*, and when the wires 60*a* and 60*b* connected to the second pads or wire pads 612*a* and 612*b* are connected to the controller 702 or the power supply 112, the connection of the wires 60*a* and 60*b* may be freely set based on the positions of the second pads or wire pads 612*a* and 612*b*. Thus, the arrangement of the controller 702 or the power supply 112 may be freely set. In another embodiment, the second pads or wire pads 612*a* and 612*b* may not be disposed on the substrate 410. The wires 60*a* and 60*b* may be electrically connected directly to the first pads or pinhole pads 610*a* and 610*b*, respectively. By adjusting the connection points between the wires 60*a* and 60*b* and the first pads or pinhole pads 610*a* and 610*b*, the connection between the wires 60*a* and 60*b* and the controller 702 or the power supply 112 may be freely set.

Figure 9:
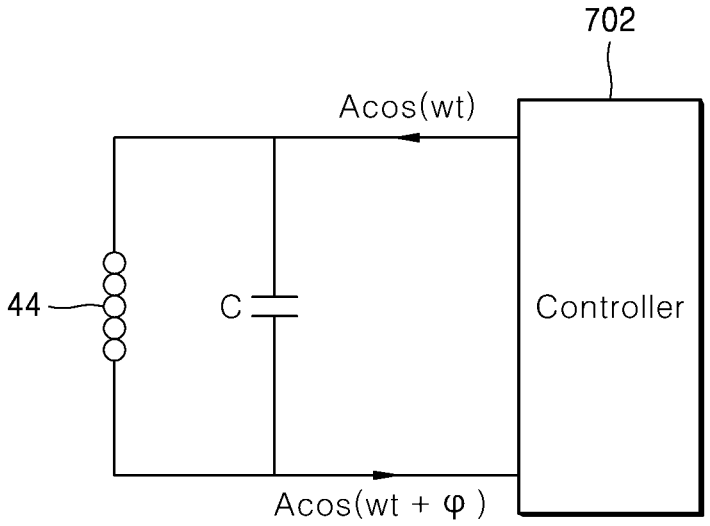
FIG. 9 is a circuit diagram of a controller according to an embodiment.

FIG. 9 is a circuit diagram of a controller 702 according to an embodiment. The controller 702 may apply an alternating current A cos(ωt) having a predetermined amplitude A and phase value ωt to the sensing coil 44 of the cooking vessel sensor 20. After applying the alternating current to the sensing coil 44, the controller 702 may receive the alternating current (now A cos(ωt+φ)) through the sensing coil 44 and may analyze its components.

When there is no cooking vessel near the sensing coil 44 or the loaded object is a non-inductive object or cooking vessel that does not contain a metal component, the phase value $\omega t+\varphi$ of the alternating current $A\cos(\omega t+\varphi)$ received through the sensing coil 44 does not exhibit a large difference from the initial phase value $\omega t$ of the alternating current that was predetermined before being applied to the sensing coil 44. So, if there are no cooking vessels near the sensing coil 44, or if the cooking vessel does not contain a metal component and is thus non-inductive, the inductance value L of the sensing coil 44 does not change much, as the inductance value L is related to the value of the alternating current, which is related to the phase value.

However, if the cooking vessel in proximity to the sensing coil 44 contains metal and is inductive, magnetic and electrical inductive phenomena occur between the cooking vessel and the sensing coil 44, and a large change occurs in the inductance value L of the sensing coil 44, and therefore a large change occurs in $\varphi$ of the phase value $\omega t+\varphi$ of the alternating current $A\cos(\omega t+\varphi)$ received through the sensing coil 44. Accordingly, the controller 702 may apply the alternating current $A\cos(\omega t)$ having a predetermined amplitude A and phase value $\omega t$ to the sensing coil 44 of the cooking vessel sensor, and then, determine whether the cooking vessel close to the working coil is inductive or not. In an exemplary embodiment, when the controller 702 applies the alternating current $A\cos(\omega t)$ having a predetermined amplitude A and phase value $\omega t$ to the sensing coil 44 of the cooking vessel sensor, the alternating current received through the sensing coil 44 may become the alternating current $A\cos(\omega t+\varphi)$ with the phase value $\omega t+\varphi$. When the phase value $\omega t+\varphi$ of the alternating current $A\cos(\omega t+\varphi)$ exceeds a predetermined first reference value, the controller 702 may determine that the cooking vessel has an induction heating property. When the phase value $\omega t+\varphi$ of the alternating current $A\cos(\omega t+\varphi)$ does not exceed the predetermined first reference value, the controller 702 may determine that the cooking vessel does not have an induction heating property or that there is no object or cooking vessel provided on the plate 106.

The controller 702 may alternatively measure an inductance value L of the sensing coil 44 when the controller 702 applies the alternating current $A\cos(\omega t)$ having a predetermined amplitude A and phase value $\omega t$ to the sensing coil 44 of the cooking vessel sensor. When the measured inductance value L of the sensing coil 44 exceeds a predetermined second reference value, the controller 702 determines that the cooking vessel is inductive, or has an inductive heating property. When the measured inductance value L of the sensing coil 44 does not exceed the predetermined second reference value, the controller 702 determines that the cooking vessel does not have an inductive heating property or that no cooking vessel is provided on the plate 106.

The controller 702 may also determine the type of the cooking vessel based on a resonance waveform generated by a resonance phenomenon caused by the sensing coil 44 and a capacitor C when the alternating current $A\cos(\omega t)$ having the predetermined amplitude A and phase value $\omega t$ is applied to the sensing coil 44. When the alternating current $A\cos(\omega t)$ is applied to the sensing coil 44, resonance may occur due to the interaction between the sensing coil 44 and the capacitor C. Such a resonance phenomenon may generate a resonance waveform that gradually attenuates with time. When there is a non-inductive cooking vessel near the sensing coil 44 or when a cooking vessel is not present, the resonance waveform may be maintained for a relatively long time. However, when an inductive cooking vessel able to be heated by induction is present in the vicinity of the sensing coil 44, the resonance waveform may be maintained for a relatively short time.

Thus, the controller 702 may measure a time period from the generation of the resonance waveform to a disappearance of the resonance waveform. When the measured time period exceeds a predetermined reference time period, the controller 702 may determine that there is a non-inductive cooking vessel near the working coil or that a cooking vessel is not present. However, when the time period from the generation of the resonance waveform to its extinction is equal to or shorter than the predetermined reference time period, the controller 702 may determine that there is an inductive cooking vessel having an inductive heating property near the working coil.

Alternatively, the controller 702 may convert a resonance waveform generated as the current applied to the sensing coil 44 into a square waveform, and may determine whether a cooking vessel is inductive based on the number of pulses of the converted square-waveform. For example, only when the voltage magnitude of the resonance waveform is greater than a predetermined reference voltage magnitude, the controller 702 may convert a resonance waveform into a square-waveform using a circuit generating a square waveform. As described above, when there is a non-inductive cooking vessel near the sensing coil 44 or when a cooking vessel is not present, the resonance waveform may be maintained for a relatively long time. Therefore, the number of pulses of the converted square-waveform may be relatively large. However, when an inductive cooking vessel able to be heated by induction is present near the sensing coil 44, the resonant waveform may be maintained for a relatively short period of time. Therefore, the number of pulses of the converted square-waveform may be relatively small. Accordingly, the controller 702 may count the number of the output square waveform pulses after current is applied to the sensing coil 44. If the number of the square-waveform pulses exceeds a predetermined reference value, the controller 702 may determine that a non-inductive heating cooking vessel exists near the working coil or that there is no cooking vessel. Further, when the number of pulses of the square-waveform is smaller than or equal to the predetermined reference value, the controller 702 may determine that there is an inductive cooking vessel having an inductive heating property near the sensing coil 44.

When it is determined that a cooking vessel placed on the plate 106 is inductive or has an inductive heating property, the controller 702 may perform a heating operation by applying an electric current to the working coil 108 such that the plate 106 where the inductive cooking vessel is placed reaches a firepower, heating power, or temperature designated by the user. During the heating operation, the controller 702 may measure the temperature of the cooking vessel being heated using the temperature sensor 402 housed within the cooking vessel sensor 20.

When the cooking vessel sensor 20 determines whether or not the cooking vessel is inductive, the power supplied to the sensing coil 44 may be less than 1 W. The magnitude of this power may be very small compared to conventional sensing methods, where the magnitude of the power supplied to a working coil may be over 200 W when applying current to a working coil conventionally.

In an exemplary embodiment, the controller 702 may be programmed to repeatedly apply the alternating current to the sensing coil 44 at a predetermined time interval (for example, 1 or 0.5 seconds) to determine whether a cooking vessel on the induction heating device is inductive or has an inductive heating property. When the controller 702 performs such repetitive current application and determination operation, the type of the cooking vessel may be determined in real time by the controller 702 whenever the user loads the cooking vessel on the induction heating device after power is applied to the induction heating device.

Figure 10:
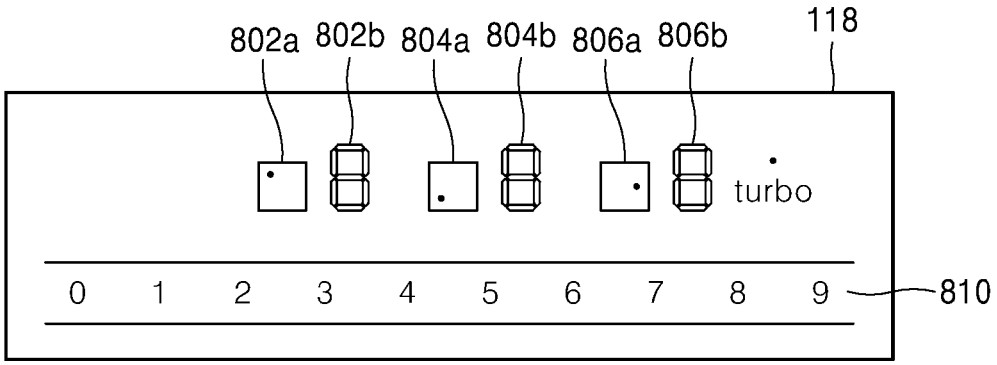
FIG. 10 shows a manipulation region of the induction heating device according to an embodiment.

FIG. 10 shows the manipulation region 118 of the induction heating device according to an embodiment. FIG. 10 shows one embodiment of the manipulation region 118, which may be located in the plate 106 as shown in FIG. 1. As shown in FIG. 10, the manipulation region 118 may include heating region buttons 802*a*, 804*a*, and 806*a* that respectively indicate positions of heating regions included in the induction heating device. The manipulation region 118 may include a heating power button 810 that controls the heating power of each heating region. Information about the three heating regions may be displayed in the manipulation region 118; however, embodiments are not limited thereto. A number of heating regions included in the induction heating device may vary. Current heating powers of the corresponding heating regions may be respectively indicated by corresponding numbers in heating power displays 802*b*, 804*b*, and 806*b*. The manipulation region 118 may further include a turbo display region that indicates a state in which a particular heating region is rapidly heated.

According to the related art, a user places a cooking vessel on a designated heating region. The user must indicate with a button the heating region on which the cooking vessel was placed. The user must then input the heating power to be applied to the cooking vessel placed on the heating region, via another button. Only then does a conventional induction heating device sense the cooking vessel and/or determine whether or not the cooking vessel on the designated heating region selected by the user has an inductive heating property. When the cooking vessel has an inductive heating property, the device applies a current to a working coil corresponding to the selected heating region to perform a heating operation that reaches the heating power designated by the user. So, according to the related art, after the user places the cooking vessel in a certain heating region, the user must specify the specific heating region to be heated via the touch of the cooking vessel selection button.

However, as described above, a current is applied to the sensing coil 44 of the cooking vessel sensor 20 repeatedly at a predetermined time interval (for example, 1 second or 0.5 seconds), and thus, the type of the cooking vessel is determined in real time based on the result. In this case, when the user places the cooking vessel in any heating region, the type of the cooking vessel may be determined immediately after the predetermined time interval elapses without further action by the user. The induction heating device does not wait for the user to select one of the heating region selection buttons 802*a*, 804*a*, or 806*a* to determine whether the cooking vessel is inductive, and may also further indicate that a certain heating region is available on one of the heating power displays 802*b*, 804*b*, or 806*b* corresponding to the heating region on which the cooking vessel was placed using a character or number (for example, 0). When such a letter or number is displayed, the user may input a heating power to be applied to the corresponding heating region via the touch of the heating power button 810. Then, the heating power input is immediately displayed in the corresponding heating power display. The induction heating device then applies a current to the working coil 108 so that the heating power of the corresponding heating region reaches the heating power input by the user. When the user places a non-inductive cooking vessel on a designated heating region, a number or letter (for example, u) to indicate that the corresponding cooking vessel is non-inductive, according to the cooking vessel determination process as described above, may be displayed in the heating power display (at least one of 802*b*, 804*n*, or 806*b*) corresponding to the designated heating region.

Eventually, after the user places an object or a cooking vessel with inductive heating properties on any heating region, the user may immediately enter the desired heating power and start the heating operation without having to press any of the heating region selection buttons 802*a*, 804*a*, or 806*a*. That is, in comparison with the related art, the induction heating device disclosed herein may eliminate an input operation by the user that selects the heating region. Further, when the user places a cooking vessel on any heating region, the device may display, on each heating power display 802*b*, 804*b*, and 806*b*, within a very short period of time, whether the corresponding cooking vessel has an inductive heating property. Therefore, the user may intuitively and quickly check the type of the cooking vessel that the user puts.

Embodiments disclosed herein aim to provide a cooking vessel sensor capable of accurately and quickly determining the type of a cooking vessel (that is, whether or not the cooking vessel is inductive or has induction heating properties) while consuming less power than a conventional one, and to provide an induction heating device including the cooking vessel sensor. Further, embodiments disclosed herein are intended to provide a cooking vessel sensor configured to simultaneously measure temperature of the cooking vessel and determine the type of the cooking vessel, and to provide an induction heating device including the cooking vessel sensor. Moreover, embodiments disclosed herein are intended to provide an induction heating device that immediately determines the type of the cooking vessel after the user places the cooking vessel on the induction heating device cooking vessel, thereby eliminating the need for a user to input or select a heating region. Embodiments disclosed herein are not limited to the above-mentioned purposes. Other purposes and advantages of the disclosed embodiments, as not mentioned above, may be understood from the following descriptions and more clearly understood from the embodiments disclosed herein. Further, it will be readily appreciated that the objects and advantages of the embodiments disclosed herein may be realized by features and combinations thereof as disclosed in the claims.

Embodiments disclosed herein may provide an induction heating device with a new cooking vessel sensor for accurately determining a type of the cooking vessel while consuming less power than in the related art. The new cooking vessel sensor according to an embodiment may have a cylindrical hollow body with a sensing coil wound on an outer face thereof. Further, a temperature sensor may be accommodated in a receiving space formed inside the body of the cooking vessel sensor. The cooking vessel sensor may be provided in a central region of the working coil and concentrically with the working coil. The cooking vessel sensor may determine the type of cooking vessel (or whether or not it is inductive) placed at the corresponding position to the working coil and simultaneously measure the temperature of the cooking vessel. In particular, the sensing coil included in the cooking vessel sensor according to embodiments disclosed herein may have fewer rotation counts and a smaller total length than those of the working coil. Accordingly, the cooking vessel sensor according to disclosed embodiments may identify the type of the cooking vessel while consuming less power as compared with the determination method of the cooking vessel using a conventional working coil.

As described above, the temperature sensor may be accommodated in the internal space of the cooking vessel sensor according to embodiments disclosed herein. Accordingly, there is an advantage that the temperature may be measured at the same time as the type of the cooking vessel may be determined, and the cooking vessel sensor may have a smaller size and volume than a conventional sensor. A cooking vessel sensor may be provided on an induction heating device, and the cooking vessel sensor may comprise a cylindrical hollow body having a first receiving space defined therein; a hollow cylindrical magnetic core received in the first receiving space wherein the hollow magnetic core has a second receiving space defined therein, and a sensing coil wound on an outer face of the body by predetermined winding counts, wherein the cylindrical hollow body has a side wall or side wall portion having a coil outlet channel or coil outlet defined therein, wherein the sensing coil passes through the coil outlet out of the body.

In an embodiment of the cooking vessel sensor, the coil outlet may include at least two coil outlets or coil outlet channels, wherein the cooking vessel sensor has at least two lead pins, wherein the sensing coil is wound around the two lead pins, and wherein the lead pins pass through the coil outlets or coil outlet channels respectively. In an embodiment of the cooking vessel sensor, the cooking vessel sensor may further include a substrate coupled to the body at a sensing coil outlet side, wherein the substrate may be configured to guide an extension of the pins in a predetermined direction. In an embodiment of the cooking vessel sensor, the substrate may include at least two lead pin holes in which the at least two lead pins may pass; and at least two first conductive lead pads or pinhole pads formed around the at least two lead pin holes, wherein the at least two first lead pads are electrically connected to the sensing coil wound around the at least two lead pins. In an embodiment of the cooking vessel sensor, the substrate may further include at least two second conductive pads or wire pads electrically connected to the at least two first pads, respectively. In an embodiment of the cooking vessel sensor, the device may further comprise a temperature sensor housed in the second receiving space.

In an embodiment of the cooking vessel sensor, the body may have lower and upper portions (or first and second outer faces or outer face portions) having different outer diameters, wherein the sensing coil may be wound on an outer face of one of the lower and upper portions, wherein said one of the lower and upper portions has a smaller outer diameter than the other of the lower and upper portions. In an embodiment of the cooking vessel sensor, the device may further comprise a guide having a third receiving space defined therein that receives the body therein, wherein the induction heating device may have a coil base on which a working coil is provided, wherein the guide has a guiding and engaged structure that guides the body and is engaged with the coil base.

Embodiments disclosed herein may provide an induction heating device comprising a plate on which a cooking vessel is placed; a working coil provided below the plate that heats the cooking vessel using an inductive current; a coil base that fixes the working coil to the induction heating device; a cooking vessel sensor provided concentrically with the working coil, wherein the working coil surrounds the cooking vessel sensor, wherein the cooking vessel sensor may include a sensing coil, wherein the sensing coil inductively reacts with a cooking vessel with an inductive heating property, and a controller that may apply a current to the sensing coil and may determine, based on a sensing result of the cooking vessel sensor, whether the cooking vessel is inductive or has an inductive heating property, wherein the cooking vessel sensor may comprise a cylindrical hollow body having a first receiving space defined therein; a hollow cylindrical magnetic core inserted in the first receiving space, wherein the hollow magnetic core has a second receiving space defined therein; and the sensing coil wound on an outer face of the body by predetermined winding counts, wherein the cylindrical hollow body has a side wall or side wall portion having a coil outlet channel or coil outlet defined therein, wherein the sensing coil passes through the coil outlet or coil outlet channel out of the body.

In an embodiment of the induction heating device, the coil outlet or coil outlet channel may include at least two coil outlets or coil outlet channels, wherein the cooking vessel sensor may have at least two lead-pins, wherein the sensing coil is wound around the two lead pins, wherein the lead pins pass through the coil outlets or coil outlet channels respectively. In an embodiment of the induction heating device, the cooking vessel sensor may further include a substrate coupled to the body at a side having the sensing coil outlet, wherein the substrate may guide an extension of the pins in a predetermined direction. In an embodiment of the induction heating device, the substrate may includes at least two lead pin holes which the at least two lead pins pass; and at least two first conductive lead pads or pinhole pads formed around the at least two lead pin holes, wherein the at least two first lead pads are electrically connected to the sensing coil wound around the at least two lead pins. In an embodiment of the induction heating device, the substrate may further include at least two second conductive pads or wire pads electrically connected to the at least two first pads respectively. In an exemplary embodiment of the induction heating device, the cooking vessel sensor may further comprise a temperature sensor housed in the second receiving space.

In an exemplary embodiment of the induction heating device, the body may have lower and upper portions or faces (or first and second outer face or outer face portions) having different outer diameters, wherein the sensing coil is wound on an outer face of one of the lower and upper portions, wherein said one of the lower and upper portions has a smaller outer diameter than the other of the lower and upper portions. In an embodiment of the induction heating device, the cooking vessel sensor may further comprise a guide having a third receiving space defined therein that receives the body therein, wherein the induction heating device may have a coil base on which a working coil is provided and wherein the guide has a guiding and engaged structure that may guide the body and may engage with the coil base.

In an embodiment of the induction heating device, the controller may be configured to determine, based on a resonance waveform generated when current is applied to the sensing coil, whether the cooking vessel is inductive or has an inductive heating property. In accordance with embodiments disclosed herein, the novel cooking vessel sensor may be capable of accurately and quickly determining the type of the cooking vessel while consuming less power than a conventional sensor. Further, the novel cooking vessel sensor may simultaneously measure a temperature of the cooking vessel and determine the type of the cooking vessel. Moreover, immediately after the user places the cooking vessel on the induction heating device, the device may automatically determine the type of the cooking vessel, thereby eliminating the need for a user action that inputs a heating region selection.

In the above description, numerous specific details are set forth in order to provide a thorough understanding of embodiments disclosed herein. Embodiments disclosed herein may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the disclosed embodiments as defined by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking vessel sensor provided in an induction heating device, the cooking vessel sensor including:

a body having a side wall and a first receiving space;

a coil outlet defined in the side wall;

a sensing coil wound on the side wall by a predetermined number of winding counts, wherein the sensing coil passes through the coil outlet out of the body;

a magnetic core provided in the first receiving space; and a temperature sensor provided in the magnetic core, wherein the magnetic core has a hollow cylindrical shape, a second receiving space is formed inside the magnetic core, and the temperature sensor is received in the second receiving space.

2. The cooking vessel sensor of claim 1, further including at least two lead pins, wherein the at least two lead pins are provided in the side wall of the body, and wherein the sensing coil is wound around the at least two lead pins after passing through the coil outlet.

3. The cooking vessel sensor of claim 2, further including a substrate coupled to the body, wherein the substrate guides an extension of the sensing coil wound around the at least two lead pins in a predetermined direction.

4. The cooking vessel sensor of claim 3, wherein the substrate includes:

at least two lead pin holes through which the at least two lead pins pass; and at least two pinhole pads formed around the at least two lead pin holes, respectively, wherein the at least two pinhole pads are formed of a conductive material and are electrically connected to the sensing coil passing through the at least two lead pin holes while wound around the at least two lead pins.

5. The cooking vessel sensor of claim 4, wherein the substrate further includes at least two wire pads formed of a conductive material and electrically connected to the at least two pinhole pads respectively.

6. The cooking vessel sensor of claim 1, wherein the side wall has a first outer face on which the sensing coil is wound, and a second outer face in which the coil outlet is defined.

7. The cooking vessel sensor of claim 1, further comprising a guide having a third receiving space that receives the body, wherein the guide has an engaged structure formed on an outer face of the guide that engages with a coil base of the induction heating device.

8. An induction heating device including:

a plate configured to receive a cooking vessel therein;

at least one working coil provided below the plate that heats the cooking vessel using an inductive current;

a coil base that fixes the working coil to the induction heating device;

a cooking vessel sensor provided concentrically with the working coil, wherein the cooking vessel sensor includes a sensing coil and wherein the working coil surrounds the cooking vessel sensor; and a controller that applies a sensing current to the sensing coil and determines, based on a sensing result of the cooking vessel sensor, whether the cooking vessel has an inductive heating property, wherein the cooking vessel sensor includes:

a body having a side wall and a first receiving space, wherein the side wall has a coil outlet;

a magnetic core received in the first receiving space, wherein the magnetic core has a hollow cylindrical shape, and a second receiving space is formed inside the magnetic core;

a temperature sensor received in the second receiving space; and a first outer face of the side wall on which the sensing coil is wound by a predetermined number of winding counts, wherein the sensing coil passes through the coil outlet out of the body.

9. The induction heating device of claim 8, wherein the cooking vessel sensor further includes at least two lead pins, wherein the at least two lead pins are provided in the side wall of the body, wherein the sensing coil is wound around the at least two lead pins.

10. The induction heating device of claim 9, wherein the cooking vessel sensor further includes a substrate coupled to the body, wherein the substrate guides an extension of the sensing coil wound around the lead pins in a predetermined direction.

11. The induction heating device of claim 10, wherein the substrate includes:

at least two lead pin holes into which the at least two lead pins pass; and at least two conductive pinhole pads formed around the at least two lead pin holes respectively, wherein the at least two pinhole pads are electrically connected to the sensing coil passing through the at least two lead pin holes while wound around the at least two lead pins.

12. The induction heating device of claim 11, wherein the substrate further includes at least two conductive wire pads electrically connected to the at least two pinhole pads respectively.

13. The induction heating device of claim 8, wherein the side wall has a second outer face on which the coil outlet is defined that has a radius that is larger than a radius of the first outer face of the side wall on which the sensing coil is wound.

14. The induction heating device of claim 8, wherein the cooking vessel sensor further includes a guide having a third receiving space in which the body is provided, wherein the guide has an engaged structure that engages with a coil base.

15. The induction heating device of claim 8, wherein the controller is configured to determine, based on a resonance waveform generated when the sensing current is applied to the sensing coil, whether the cooking vessel is has an inductive heating property.

16. The induction heating device of claim 8, wherein the sensing current applied by the controller is an alternating current with a predetermined amplitude and phase value, and wherein the controller senses components of the phase value of the alternating current after the alternating current passes through the sensing coil.

17. The induction heating device of claim 8, wherein the controller repeatedly applies the sensing current to the sensing coil at a predetermined time interval to determine whether a cooking vessel on the induction heating device is inductive or has an inductive heating property.

18. The induction heating device of claim 8, wherein the controller determines a region of the plate on which a cooking vessel having an inductive heating property is placed.

19. An induction heating device including:

a plate on which a cooking vessel is placed;

a first working coil provided below the plate that heats the cooking vessel using an inductive current;

a coil base that fixes the working coil to the induction heating device;

a cooking vessel sensor provided concentrically within the working coil, wherein the cooking vessel sensor includes:

a body having a side wall and a first receiving space, wherein the side wall has a coil outlet;

a magnetic core received in the first receiving space, wherein the magnetic core has a hollow cylindrical shape, and a second receiving space is formed inside the magnetic core;

a temperature sensor provided inside of the second receiving space; and a sensing coil wound on an outer face of the side wall by a predetermined number of winding counts, wherein the sensing coil passes through the coil outlet out of the body.

20. The induction heating device of claim 19, further including a second working coil, wherein a size of a sum of a rotation count of the first working coil and a rotation count of the second working coil may be limited by a size of the coil base, and wherein a size of a rotation count of the sensing coil may be limited by a size of the outer face of the side wall of the body of the cooking vessel sensor.

* * * * *